US005760322A

United States Patent [19]

Ward et al.

[11] Patent Number: 5,760,322

[45] Date of Patent: Jun. 2, 1998

[54] GUITAR WITH DEVIATIONS TO STRAIGHT FRET ARCHITECTURE

[76] Inventors: Nic Ward, 11 Bega Pl Narrabundah, Act, Australia; Ian Gorman, 164 Lawrence Wackett Theodore, 2905, Act, Australia

[21] Appl. No.: 557,002

[22] PCT Filed: Sep. 9, 1994

[86] PCT No.: PCT/AU94/00540

§ 371 Date: Jun. 7, 1996

§ 102(e) Date: Jun. 7, 1996

[87] PCT Pub. No.: WO95/07528

PCT Pub. Date: Mar. 16, 1995

[30] Foreign Application Priority Data

Sep. 9, 1993 [AU] Australia ..... PM1178

[51] Int. Cl.[6] ..... G10D 3/06

[52] U.S. Cl. ..... 89/314 R

[58] Field of Search ..... 84/314 R, 293, 84/267

[56] References Cited

U.S. PATENT DOCUMENTS

| | | | |
|---|---|---|---|
| 3,635,116 | 1/1972 | Pelensky | 84/314 R |
| 4,132,143 | 1/1979 | Stone | 84/314 R |
| 4,852,450 | 8/1989 | Novak | 84/314 R |
| 5,133,239 | 7/1992 | Thomas | 84/314 R |

FOREIGN PATENT DOCUMENTS 1-197792 8/1989 Japan .

OTHER PUBLICATIONS

Article in Publication "Acoustic Guitar"–by John Schneider entitled 'Fine Tuning' Issue No. 24 May/Jun. 1994, USA.

*Primary Examiner*—Cassandra C. Spyrou

[57] ABSTRACT

A fingerboard for a guitar or similar stringed musical instrument has fixed standard right angle frets on the face of the instruments neck. The invention resides in a measured deviation in the fret at specific fret/string intersections. This is for the purpose of improving the tuning accuracy of the instrument.

6 Claims, 1 Drawing Sheet

GUITAR WITH DEVIATIONS TO STRAIGHT FRET ARCHITECTURE

TECHNICAL FIELD

This invention relates to the tuning of the conventional guitar or similar fret bearing stringed musical instrument which specifically encorporates the use of fixed standard right angle frets on the face of the fretboard, with said frets as fundamental to the selection of notes produced by the instrument.

There is disclosed a measured deviation in the fret architecture for the purpose of improving the tuning accuracy of the instrument, principally within the 'primary' or 'first position' playing area of the fretboard—FIG. 2.1—1 depicts this as the area of the fretboard contained within the first three frets adjacent to the fixed nut at the head of the instrument.

DISCUSSION OF BACKGROUND ART

Conventional art provides a bridge (3) which is located in the lower portion of the instrument, the body (4) the strings are tensioned from fixing points (5) over the bridge and across the full length of the fretboard (6) then over a fixed nut (7), similar to a small bridge, and finally being fixed to tuning keys (8) located on the head (9) of the instrument.

As is well documented in patents relevant to the art; the frequency of a note played on a fretted stringed musical instrument is determined by the distance between the aforementioned fret and the bridge, a point of permanent fixture for the string. In essence, the pitch of a string is dictated by its tension, thickness and length when played. The conventional fretboard provides straight wire frets (10) affixed at right angles over the length of the fretboard. All frets are positioned parallel to each other and at diminishing intervals on said fretboard in the direction away from the head towards the body of the instrument.

The strings passing perpendicularly over the fretboard do so in an equidistant manner at each fret interval as a result of the straight and parallel positioning of said frets on said fretboard. The tuning of the conventional instrument constructed in this manner is termed 'equal temperament tuning', a direct reference to the equal positioning of the parallel fret intervals over which all the strings traverse.

Mass produced quantities of the guitar of various makes and quality currently provide for the tuning of these instruments exclusively in equal temperament by way of parallel conventional fret architecture. The invention of predetermined deviation to conventional fretting herein disclosed was born out of observing an inherent tuning flaw in strict parallel fretting. The said tuning flaws appearing as pitch 'sharpening' being present in correctly tuned guitars of varying makes and quality. This 'sharpening' of pitch being distinctly pronounced upon the application of two or more 'fretted' notes simultaneously i.e.: chords and principally within the area of the primary or first position referred to in the aforementioned technical field.

As this first position is the most universal playing area of the fretboard for guitar players of various abilities, said pitch sharpening produced by conventional parallel fretting detracts from the tuning accuracy of the instrument and therefore also from performance quality.

It should be noted that discrepancies in tuning accuracy of fretted musical instruments has long been problematic to players, lutanist having been known centuries earlier to 'fine tune' their instrument prior to performances. This was simply achieved by adjusting the gut string frets which were wrapped around the neck of the instrument and tied in place.

In 1829 a 30 page booklet of instructions accompanied the first fret adjustable guitar invented by englishman T. Perronet Thompson. This instrument required specific refretting for each of the 12 musical keys of the diatonic or western music scale. The impractical task of repositioning each singular fret required for key changes was further complicated by having to sit with the body tilted backwards, as the 'frets' were prone to falling out of their pre-drilled position holes.

In the 20th century the first guitars to use 'unusual' fretting were built in 1920 by mexican Julian Carillo and in the 1930's by czech Alois Haba. Both designed guitars to achieve 'quarter' tone intervals in the various keys. Neither departed from the use of straight parallel frets. American Harry Partch in 1940 provided the first guitar which achieved the accuracy of tuning Thompson was seeking over a century earlier. Partchs' guitar was designed to produce what is termed 'just intonation' i.e.: pure intervals within the diatonic musical scale. The use of parallel and straight right angle fret architecture was once again the means by which Partchs' guitar functioned, varying only in fret position or length. American Tom Stone later borrowed from Partchs' understanding that the offending tuning flaws of equal temperament eminated only from the fretboard. In 1970 Stone patented the Interchangeable Fret Board consisting of 12 separate metal fretting 'templates' selectively mounted on a magnetic guitar neck. Each template relied upon parallel and straight frets, again varying only in length and positioning.

At about the same time as Stones' invention a lutanist Walter Vogt devised his solution to the 'out of tuneness' of equal temperament, the Fine Tunable Precission Fretboard. This instrument functioned by means of grooves cut into the fret board directly underlying each string. 'T' shaped frets were then positioned at each selected string/fret intersection and affixed by 'O' rings. The time consuming task of resetting each fret individually for key changes remained.

American inventor Ralph Novak again touched on fret restructuring in 1989 with U.S. Pat. No. 4,852,450, with his guitar designed to achieve different scale lengths. However, still the frets remained straight. Japanese patent 1-197792 once again varies from conventional art though again only in the length of the straight and parallel frets used.

U.S. Pat. No. 5,133,239 proposes fretting for the guitar in a manner providing an oblique like fret topography eminating from the nut and extending longitudinally down towards the body of the instrument. Though departing from conventional fret architecture, the essence and objective is to achieve a 'coloring' or 'vibrato' effect whereby the vibrato technique applied to the playing of a 'non' fretbearing stringed instrument e.g.: the violin, can be adapted to the fretted instrument i.e.: the guitar, by means of the 'player treatment' applied to this essentially sideways oblique fret architecture.

DISCLOSURE OF INVENTION

The deviations in the frets herein disclosed directly counters the pitch 'sharpening' in conventional art. This is achieved by departing from the straight line fret architecture at pitch 'offending' string/fret intersections within the first position playing area of the fretboard. The introduction of fret deviations at these points provides a measured 'flattening' of the notes produced at said intersections. By adjusting the form of the straight fret to introduce a salient and distinct shift in the fret in the direction away from the body and towards the head of the instrument, a lengthening of the string is achieved. This result is a 'flattening' of pitch of the note produced at the new string/fret intersections. The salient deviation to the straight fret that produces the improved tuning qualities herein referred to is achieved at string/fret intersections indicated in FIGS. 2. as;

i/ The note 'G sharp' form by finger pressure applied to string '3' of the instrument (11), being the string which is tuned to the note 'G natural' of the diatonic scale. This finger pressure is applied to the string within the area (12) between the fixed nut (7) and the first new string/fret intersection (13) and;

ii/ The 'C sharp' formed by finger pressure applied to string '2' of the instrument (14) being the string which is tuned to the note 'B natural' of the diatonic scale. This finger pressure is applied to the string within the area (15) between the first string/fret intersection (18) and the second new string/fret intersection (16)

BEST MODE OF CARRYING OUT OF THE INVENTION

Figure 1:
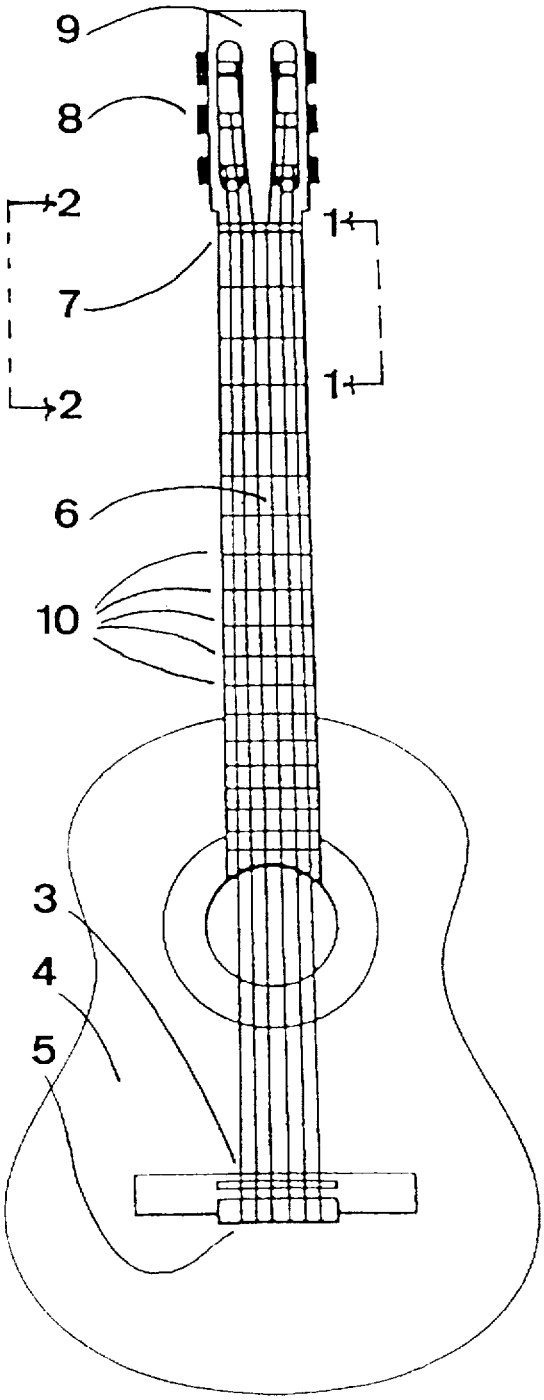
FIG. 1 PRIOR ART
FIG. 1. is an illustration of the face of a conventional fretted stringed guitar representative of the known art.
Figure 2:
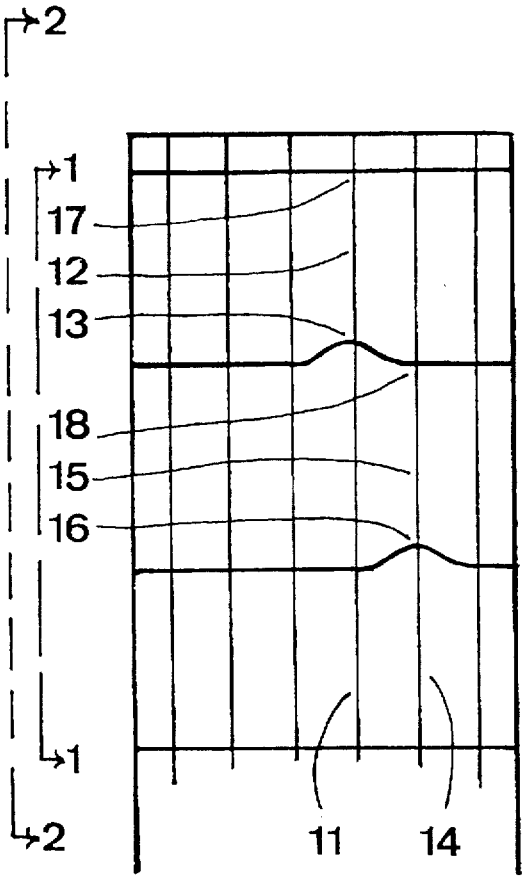
Fig. 2. is a compressed view of the FIG. 1. illustration taken at 2—2 bearing the fret deviations of this invention embodied within the first playing position of the fretboard (1—1).

As is specifically referred to in the disclosure, the optimum flattening effect to the offending string/fret intersections are rendered to said intersections at points (13) and (16) of FIG. 2. The salient deviation to the frets at said string/fret intersections provides a distinct 'lowering' of pitch at said intersections, which is a direct result of the physical deviation from the conventional straight fret architecture.

The introduction of said new string/fret intersections of this invention reduces the distances between said conventional string/fret intersections and their respective preceding fixed points or next lowest notes, i.e.: points (17) and (18), by a factor generally not exceeding 8.333 cents. Being 1/12th the distance between the original string/fret intersections of prior art.

The said new frets are affixed in the conventional manner by means of a preceding groove being cut into the face of the fretboard at the conventional intervals. Said grooves are cut to specific topography to accommodate the 2 new frets subsequently affixed in position by a bonding agent as required.

SUMMARY OF INDUSTRIAL APPLICABILITY OF INVENTION

The introduction of new fret architecture to the first playing position of the guitar fretboard herein disclosed requires minimal departure from the current manufacturing and assembly procedure of conventional art. Application of the invention directly involves minor measured reshaping of only 2 new frets, coupled with the corresponding grooves to be cut to accommodate the mounting of said new frets.

The application of the 2 new frets to various guitars has demonstrated that this invention significantly enhances the tuning performance of even the most modest and inexpensive examples of the instrument.

We claim:

1. A musical stringed instrument comprising:

a plurality of strings;

a plurality of frets overlaid by said strings such that said strings intersect said frets;

at least one of said frets including a linear member and a curved portion positioned with a portion of said linear member on each side thereof, said curved portion at a location where one of said strings intersects said at least one of said frets.

2. The musical stringed instrument according to claim 1 wherein:

said linear member being configured to alter the musical notes of the strings intersecting the linear member by a factor;

said curved portion being configured to alter the musical note of said one of said strings by a second factor, said second factor being said first factor altered by up to about 1/12th of a semitone of diatonic musical scale.

3. The musical stringed instrument according to claim 1 wherein:

said linear member being configured to alter the musical notes of the strings intersecting the linear member by a factor;

said curved portion being configured to alter the musical note of said one of said strings by a second factor, said second factor being said first factor flattened by up to about 1/12th of a semitone of diatonic musical scale.

4. The musical stringed instrument according to claim 1 wherein:

the musical note produced by said one of said strings intersecting said curved portion being G sharp altered by a factor up to about 1/12th of a semitone of diatonic musical scale.

5. The musical stringed instrument according to claim 1 wherein:

the musical note produced by said one of said strings intersecting said curved portion being C sharp altered by a factor up to about 1/12th of a semitone of diatonic musical scale.

6. The musical stringed instrument according to claim 1 wherein:

said curved portion of said fret is retrospectively affixed to said musical instrument.

* * * * *